US008711042B2

(12) United States Patent
Taniyama et al.

(10) Patent No.: US 8,711,042 B2
(45) Date of Patent: Apr. 29, 2014

(54) MOBILE COMMUNICATION DEVICE

(75) Inventors: Kazutoshi Taniyama, Kawasaki (JP); Masaru Kanazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 223 days.

(21) Appl. No.: 13/314,937

(22) Filed: Dec. 8, 2011

(65) Prior Publication Data

US 2012/0218153 A1 Aug. 30, 2012

(30) Foreign Application Priority Data

Feb. 28, 2011 (JP) ..... 2011-042494

(51) Int. Cl.
*H01Q 1/24* (2006.01)

(52) U.S. Cl.
USPC ..... 343/702

(58) Field of Classification Search
USPC ..... 343/702; 455/575.1, 575.4
See application file for complete search history.

(56) References Cited

U.S. PATENT DOCUMENTS

| | | | | |
|---|---|---|---|---|
| 7,343,183 | B2 | 3/2008 | Iguchi | |
| 7,554,497 | B2 * | 6/2009 | Ohba et al. | 343/702 |
| 7,609,212 | B2 * | 10/2009 | Sato et al. | 343/702 |
| 8,311,599 | B2 * | 11/2012 | Hikino | 455/575.4 |
| 2010/0245178 | A1 * | 9/2010 | Hsieh et al. | 343/702 |
| 2012/0038516 | A1 * | 2/2012 | Hsieh et al. | 343/702 |

FOREIGN PATENT DOCUMENTS

| | | |
|---|---|---|
| JP | 2003-264355 | 9/2003 |
| JP | 2005-192055 | 7/2005 |
| JP | 2005-318566 | 11/2005 |
| JP | 2009-44224 | 2/2009 |

* cited by examiner

*Primary Examiner* — Hoang V Nguyen
(74) *Attorney, Agent, or Firm* — Fujitsu Patent Center

(57) ABSTRACT

A mobile communication device equipped with a microphone, a receiver, a first circuit board which is provided with an antenna at the microphone side and a second circuit board opposing to the first circuit board, wherein the antenna has a first antenna part which is extended parallel to the edge of the first circuit board and a second antenna part which is extended from a free end of the first antenna part towards the second circuit board. The end of the second antenna part may also be extended in a direction parallel to the second circuit board so as to form a third antenna part. As a result, even if a user uses the device in a state with the receiver pressed against the ear, the antenna will not be affected by the user body and the antenna characteristics will not deteriorate.

19 Claims, 14 Drawing Sheets

MOBILE COMMUNICATION DEVICE

CROSS-REFERENCE TO RELATED APPLICATION

This application is based upon and claims the benefit of priority of the prior Japanese Patent Application No. 2011-042494, filed on Feb. 28, 2011, the entire contents of which are incorporated herein by reference.

FIELD

The present application relates to a mobile communication device. In the embodiments which are explained below, a mobile phone which is designed to reduce the deterioration of characteristics of the antenna at the time of conversation is explained as an embodiment.

BACKGROUND

An openable wireless communication device having a movable housing and a fixed housing both of which are provided with circuit boards which are electrically coupled by a connecting part which is provided at the sides of the two circuit boards at the ends of the housings is disclosed in Japanese Laid-Open Patent Publication No. 2005-192055 (hereinafter referred to as JP-A-2005-192055). In the device disclosed in JP-A-2005-192055, due to the connecting part, the current vectors of the two circuit boards are oriented toward the power feed point of the antenna. Due to this, the ground parts formed at the two circuit boards are coupled by high frequency coupling, so the antenna characteristics are improved. This art is illustrated in JP-A-2005-192055.

In a mobile phone, to improve the antenna characteristics in the conversation state, improvement of the antenna characteristics in the conversation state where the mobile phone is in close contact with the user body, in particular, the head, is being studied. In this regard, up to now, when studying mounting of an antenna in a mobile phone, the antenna mounting has been studied while stressing the improvement of the antenna characteristics of the mobile phone when placed in free space. For this reason, the antenna characteristics sometimes deteriorated at the time of use of the mobile phone in close contact with the user body. For example, there are flip-type mobile phones and slide-type mobile phones which, in the closed state, have antennas which are carried in the housings at the user body sides at the time of conversation. In such a mobile phone, sometimes the high frequency current which flows through the housing which is positioned at the user body side at the time of conversation ends up being absorbed by the user body and therefore the antenna characteristics end up deteriorating. Even if employing the configuration described in JP-A-2005-192055 where the circuit boards of the movable housing and the fixed housing are connected by a connecting part, the electrical coupling degree was weak and control of the current vector of the high frequency current was difficult.

SUMMARY

A first configuration of the mobile communication device of the present application is a mobile communication device which has a first circuit board, a second circuit board which faces the first circuit board, and an antenna which is connected to the first circuit board, in which mobile communication device, the antenna has a first antenna part which is laid in a direction parallel to the first circuit board and a second antenna part which is laid in direction bent to a second circuit board side at the end of the first antenna part at a side far from the first circuit board.

A second configuration of the mobile communication device of the present application is a mobile communication device which has a first circuit board, a second circuit board which faces the first circuit board, and an antenna which is connected to the first circuit board, in which mobile communication device, the antenna has a first antenna part which is laid in a direction parallel to the first circuit board and a board extension part which includes an end of the second circuit board extended to a position right under the first antenna part.

A third configuration of the mobile communication device of the present application is a mobile communication device which has a first circuit board, a second circuit board which faces the first circuit board, and an antenna which is connected to the first circuit board, in which mobile communication device, the antenna has a first antenna part which is laid in a direction parallel to the first circuit board and a part which includes a conductor which is attached to an end of the second circuit board and which is positioned right under the first antenna part.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Below, modes of working the present application will be explained in detail based on specific embodiments using the attached drawings. Further, the same component members are explained while assigned the same reference notations.

Figure 1:
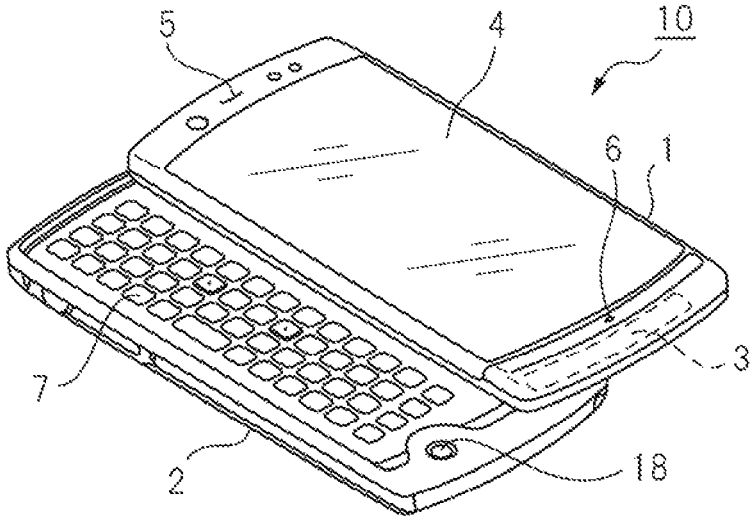
FIG. 1 is a perspective view which illustrates a slid open state of a lateral slide-type mobile phone of one example of a mobile communication device of a first aspect of the present application.
Figure 2:
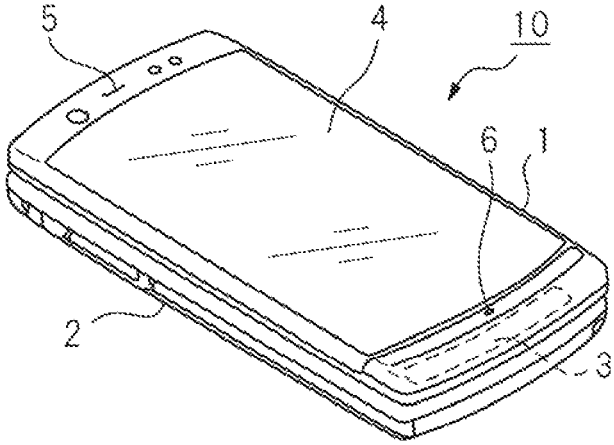
FIG. 2 is a perspective view which illustrates a closed state of the lateral slide-type mobile phone which is illustrated in FIG. 1.

FIG. 1 and FIG. 2 illustrate a lateral slide-type mobile phone 10 of one example of a mobile communication device according to a first aspect of the present application. The lateral slide-type mobile phone 10 is provided with a first housing comprised of an upper housing 1 and with a second housing comprised of a lower housing 2. FIG. 1 illustrates a state where the upper housing 1 is slid away from the lower housing 2, while FIG. 2 illustrates a state where the upper housing 1 is superposed over the lower housing 2 and the phone is closed. Here, "lateral slide" means the upper housing 1 sliding in a short direction with respect to the lower housing 2. The upper housing 1 sliding in the long direction with respect to the lower housing 2 is referred to as "longitudinal slide". The lateral slide-type mobile phone 10 of the first aspect is provided with mobile phone functions at the upper housing 1 and computer-like electronic device functions at the lower housing 2.

Figure 3:
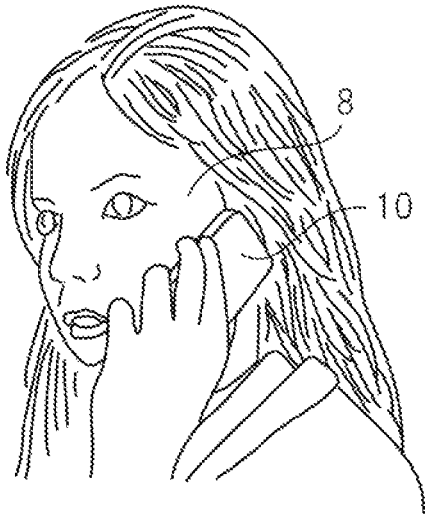
FIG. 3 is a perspective view which illustrates a usage state of the lateral slide-type mobile phone which is illustrated in FIG. 2.

At the lateral slide-type mobile phone 10, as illustrated in FIG. 1, input keys 7 which appear when the upper housing 1 is slid away from the lower housing 2 are provided at the lower housing 2. At the upper housing 1, there is a display 4, receiver 5, and microphone 6. As the receiver 5, a speaker is provided inside of the upper housing 1. Further, as the microphone 6, a microphone is provided inside of the upper housing 1. Furthermore, inside of the top housing 1 near the microphone 6, an antenna 3 is provided for sending and receiving signals. The thus configured lateral slide type mobile phone 10, as illustrated in FIG. 3, is used in a closed state at the time of conversation. Note that, the antenna 3 does not need to be arranged near the microphone 6.

In the lateral slide-type mobile phone 10, as illustrated in FIG. 4 and FIG. 5 to FIG. 8, a flat antenna 3 is connected through a connection terminal 13 to the first circuit board 11 which is housed in the upper housing 1. At the connection terminal 13, a spring for feed of antenna power (not illustrated) is housed. The antenna 3 is arranged in parallel to the first circuit board 11. At the back side of the first circuit board 11, a baseband chip 24 which is provided with a telephone function is provided. Further, at the lower housing 2, a second circuit board 12 is housed. The first circuit board 11 and the second circuit board 12 are connected by a flexible cable (FPC) 15. Reference numeral 14 illustrates a connection part of the FPC 15 to the first circuit board 11, while 16 illustrates a connection part of the FPC 15 to the second circuit board 12.

Figure 4:
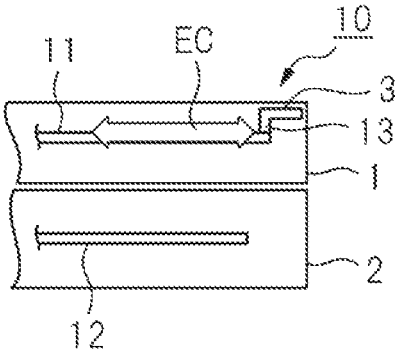
FIG. 4 is a partial cross-sectional view which illustrates an image of current which flows through a first circuit board equipped with a flat antenna in the usage state of the lateral slide-type mobile phone which is illustrated in FIG. 3.

In the thus configured lateral slide-type mobile phone 10, there was the inconvenience that the antenna characteristics ended up deteriorating at the time of conversation. This inconvenience was due to the fact that in a mobile phone having an antenna for low frequency use of the 800 MHz band, the signal was emitted by running current through the housing as a whole, so when used in the state which is illustrated in FIG. 3, the high frequency current which flowed through the top housing ended up being absorbed by the user body (head) 8. That is, if the current EC which flows through the first circuit board 11 which is illustrated in FIG. 4 is large, the high frequency current which flows through the top housing 1 also becomes large and the effect of the user body becomes larger.

Therefore, in the present application, there is provided a mobile communication device of a first aspect wherein a top housing 1 slides in a lateral direction from a bottom housing 2, in particular a lateral slide-type mobile phone 10, wherein a current EC which flows through the first circuit board 11 is dispersed and a dispersed current ec flows through the second circuit board 12. That is, in the present antenna, the voltage becomes maximum at the end of the antenna element, so by bending this end in a direction approaching the second circuit board 12 which is at the side far from the user body, the dispersed current ec flows through the second circuit board 12. FIG. 9 to FIG. 12 illustrate basic first to fourth embodiments of the present application, while FIG. 13 to FIG. 16 illustrate fifth to eighth embodiments comprised of combinations of the first to fourth embodiments.

Figure 9:
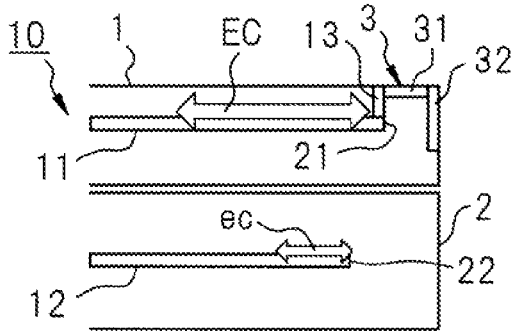
FIG. 9 is a partial cross-sectional view which illustrates a shape of an antenna in a first embodiment of a mobile communication device of the present application.

FIG. 9 is a partial cross-sectional view which illustrates the shape of an antenna 3 of a first embodiment of a lateral slide-type mobile phone 10 of the present application. In the first embodiment, an antenna 3 which is connected through a connection terminal 13 to the first circuit board 11 which is housed in the top housing 1 includes a first antenna part 31 and a second antenna part 32. The first antenna part 31 is provided laid along an end 21 of the first circuit board 11 in a direction parallel to the first circuit board 11, while the second antenna part 32 extends from the end of the first antenna part 31 and is bent to the second circuit board 12 side. The current EC which flows through the first circuit board 11 flows dispersed as the current ec to the second circuit board 12 due to this second antenna part 32. Note that, the second antenna part 32 may be configured by a separate member from the first antenna part 31 and joined to the first antenna part 31.

Figure 10:
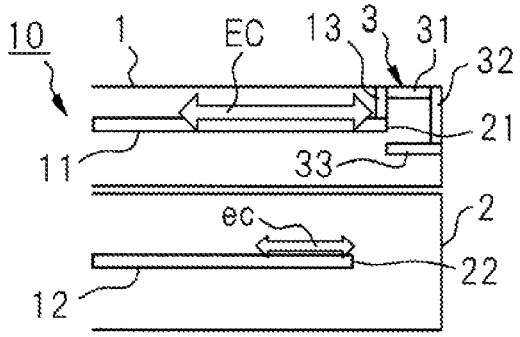
FIG. 10 is a partial cross-sectional view which illustrates a shape of an antenna in a second embodiment of a mobile communication device of the present application.

FIG. 10 is a partial cross-sectional view which illustrates the shape of an antenna 3 in a second embodiment of a lateral slide-type mobile phone 10 of the present application. In the second embodiment, the antenna 3 which is connected through a connection terminal 13 to the first circuit board 11 which is housed in the top housing 1 includes a first antenna part 31, a second antenna part 32, and a third antenna part 33. The first antenna part 31 is provided laid along an end 21 of the first circuit board 11 in a direction parallel to the first circuit board 11, while the second antenna part 32 is provided extending from the end of the first antenna part 31 and bent to the second circuit board 12 side. Furthermore, a third antenna part 33 is provided extending from the end of the second antenna part 32 with this extension part bent in a direction parallel to the second circuit board 12. The current EC which flows through the first circuit board 11 flows dispersed as the current ec to the second circuit board 12 due to this second antenna part 32 and third antenna part 33.

Note that, the above-mentioned first antenna part 31, second antenna part 32, and third antenna part 33 may be formed by bending a single member or may be formed by preparing separate members and joining them together. The first antenna part 31, second antenna part 32, and third antenna part 33 are configured in the same way in the following embodiments as well.

Figure 11:
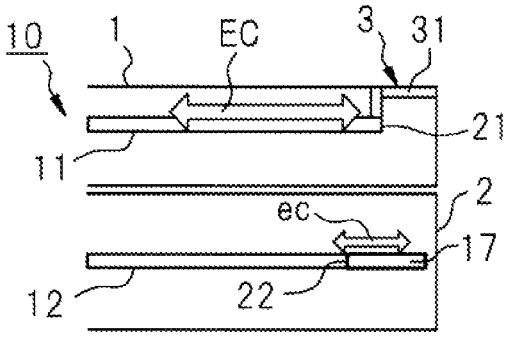
FIG. 11 is a partial cross-sectional view which illustrates a shape of a second circuit board in a third embodiment of a mobile communication device of the present application.

FIG. 11 is a partial cross-sectional view which illustrates the shape of the second circuit board 12 in a third embodiment of the lateral slide-type mobile phone 10 of the present application. In the third embodiment, the antenna 3 which is connected through a connection terminal 13 to the first circuit board 11 which is housed in the top housing 1 includes only a first antenna part 31. On the other hand, the end 22 of the second circuit board 12 extends to a position right under the antenna 3 to provide a board extension part 17. The current EC which flows through the first circuit board 11 flows dispersed as the current ec to the second circuit board 12 due to this board extension part 17.

Figure 12:
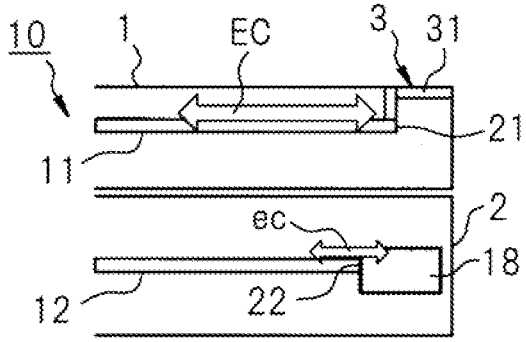
FIG. 12 is a partial cross-sectional view which illustrates a shape of a second circuit board in a fourth embodiment of a mobile communication device of the present application.

FIG. 12 is a partial cross-sectional view which illustrates the shape of the second circuit board 12 in a fourth embodiment of the lateral slide-type mobile phone 10 of the present application. In the fourth embodiment, the antenna 3 which is connected through a connection terminal 13 to the first circuit board 11 which is housed in the top housing 1 includes only a first antenna part 31. On the other hand, at the end 22 of the second circuit board 12, a part 18 which includes a conductor is attached to be positioned right under the antenna 3. The part 18 which includes a conductor may also be attached to the second circuit board 12 without extending the end 22 of the second circuit board 12. Further, it is also possible to extend the end 22 of the second circuit board 12 and have that extension part attached to. The current EC which flows to the first circuit board 11 flows dispersed as the current ec to the second circuit board 12 due to this part 18 which includes a conductor.

Figure 13:
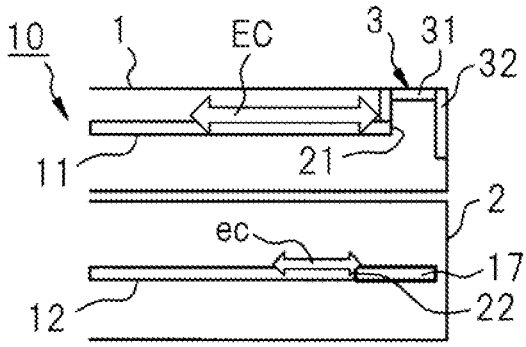
FIG. 13 is a partial cross-sectional view which illustrates a fifth embodiment of a mobile communication device of the present application and illustrates a state combining the antenna of the first embodiment and the second circuit board of the third embodiment.

FIG. 13 is a partial cross-sectional view which illustrates a fifth embodiment of a lateral slide type mobile phone 10 of the present application. This is an embodiment which combines the antenna 3 of the first embodiment and the second circuit board 12 of the third embodiment. That is, if configuring the antenna 3 from the above-mentioned first antenna part 31 and second antenna part 32 and providing the end 22 of the second circuit board 12 with a board extension part 17 which is extended to a position right under the antenna 3, the fifth embodiment is obtained. The current EC which flows to the first circuit board 11 flows dispersed as the current ec to the second circuit board 12 due to this second antenna part 32 and board extension part 17.

Figure 14:
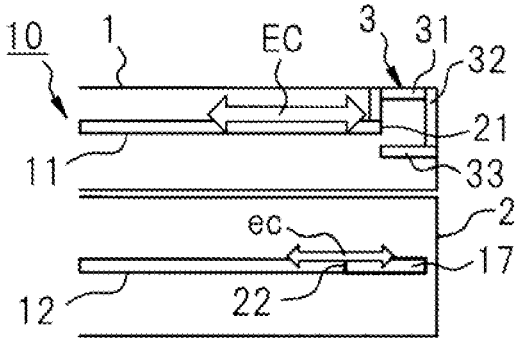
FIG. 14 is a partial cross-sectional view which illustrates a sixth embodiment of a mobile communication device of the present application and illustrates a state combining the antenna of the second embodiment and the second circuit board of the third embodiment.

FIG. 14 is a partial cross-sectional view which illustrates a sixth embodiment of a lateral slide type mobile phone 10 of the present application. This is an embodiment which combines the antenna 3 of the second embodiment and the second circuit board 12 of the third embodiment. If configuring the antenna 3 from the above-mentioned first antenna part 31, second antenna part 32, and third antenna part 33 and providing the end 22 of the second circuit board 12 with a board extension part 17 which is extended to a position right under the antenna 3, the sixth embodiment is obtained. The current EC which flows to the first circuit board 11 flows dispersed as the current ec to the second circuit board 12 due to this second antenna part 32, third antenna part 33, and board extension part 17.

Figure 15:
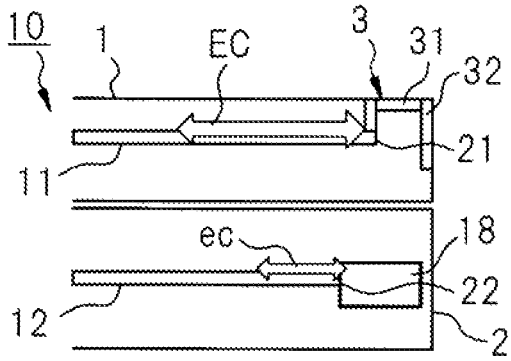
FIG. 15 is a partial cross-sectional view which illustrates a seventh embodiment of a mobile communication device of the present application and illustrates a state combining the antenna of the first embodiment and the second circuit board of the fourth embodiment.

FIG. 15 is a partial cross-sectional view which illustrates a seventh embodiment of a lateral slide type mobile phone 10 of the present application. This is an embodiment which combines the antenna 3 of the first embodiment and the second circuit board 12 of the fourth embodiment. That is, the antenna 3 includes the above-mentioned first antenna part 31 and second antenna part 32. At the end 22 of the second circuit board 12, the part 18 which includes a conductor is attached to be positioned right under the antenna 3. The part 18 which includes a conductor may also be attached to the second circuit board 12 without extending the end 22 of the second circuit board 12. Further, it is also possible to extend the end 22 of the second circuit board 12 and have that extension part attached to. The current EC which flows to the first circuit board 11 flows dispersed as the current ec to the second circuit board 12 due to this second antenna part 32 and part 18 which includes a conductor.

Figure 16:
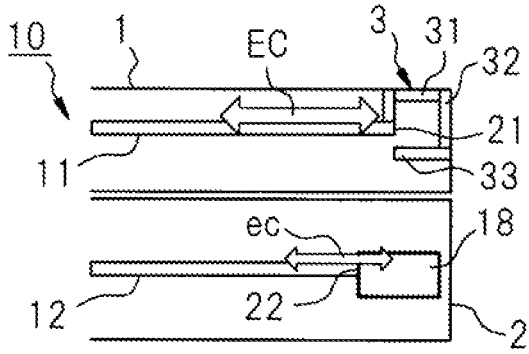
FIG. 16 is a partial cross-sectional view which illustrates an eighth embodiment of a mobile communication device of the present application and illustrates a state combining the antenna of the second embodiment and the second circuit board of the fourth embodiment.

FIG. 16 is a partial cross-sectional view which illustrates an eighth embodiment of the mobile communication device of the present application and is a partial cross-sectional view which illustrates the state of the antenna 3 of the second embodiment and the second circuit board 12 of the fourth embodiment combined. The antenna 3 includes the above-mentioned first antenna part 31, second antenna part 32, and third antenna part 33. At the end 22 of the second circuit board 12, the part 18 which includes a conductor is attached so as to be positioned right under the antenna 3. The current EC which flows to the first circuit board 11 flows dispersed as the current ec to the second circuit board 12 due to this second antenna part 32, third antenna part 33, and part 18 which includes a conductor.

Figure 17:
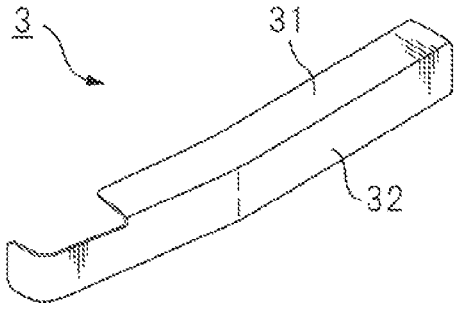
FIG. 17 is a perspective view which views the shape of the antenna of the first embodiment of the present application from the front side.
Figure 18:
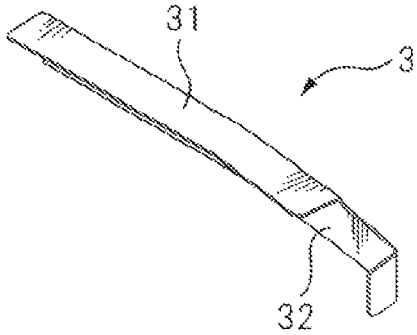
FIG. 18 is a perspective view which views the shape of the antenna of the first embodiment of the present application from the back side.
Figure 19:
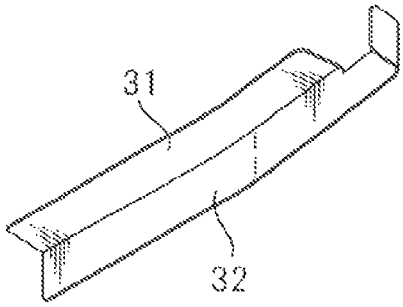
FIG. 19 is a perspective view which views the shape of the antenna of the first embodiment of the present application from the bottom.

FIG. 17 to FIG. 19 are perspective views which view the specific shape of the antenna 3 of the first embodiment of the present application from three directions. The antenna 3 of the first embodiment is provided with a first antenna part 31 and with a second antenna part 32 which extends from the first antenna part 31 and is bent in perpendicular direction. The second antenna part 32 is further extended from the end of the first antenna part 31 and bent at its extension part along the edge of the first circuit board 11.

Figure 5:
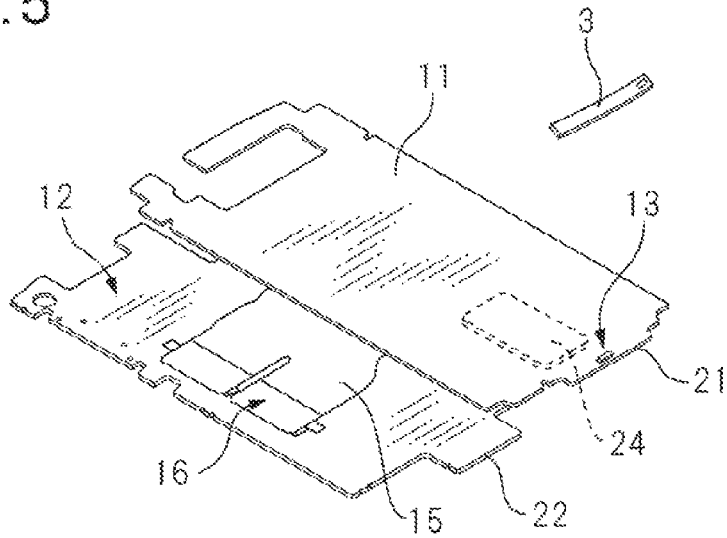
FIG. 5 is an assembled perspective view which illustrates the states of the first circuit board and the second circuit board and the antenna which is attached to the first circuit board inside the lateral slide-type mobile phone in the slid open state which is illustrated in FIG. 1.
Figure 6:
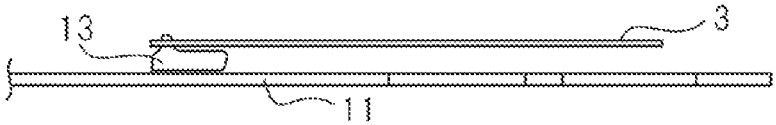
FIG. 6 is a partial cross-sectional view which illustrates connection of the antenna and first circuit board which are illustrated in FIG. 5.
Figure 7:
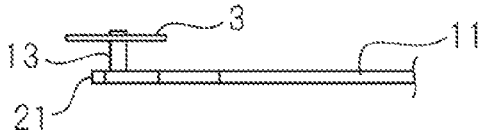
FIG. 7 is a partial cross-sectional view which views the connection of the antenna and the first circuit board which are illustrated in FIG. 6 from a direction perpendicular to FIG. 6.
Figure 8:
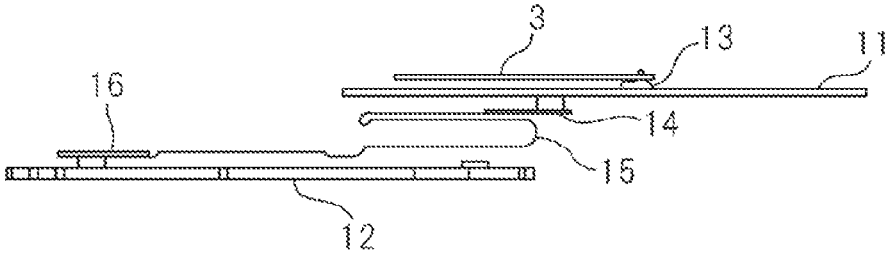
FIG. 8 is a partial cross-sectional view which illustrates a state where the first circuit board and the second circuit board which are illustrated in FIG. 5 are connected by a flexible cable.
Figure 20:
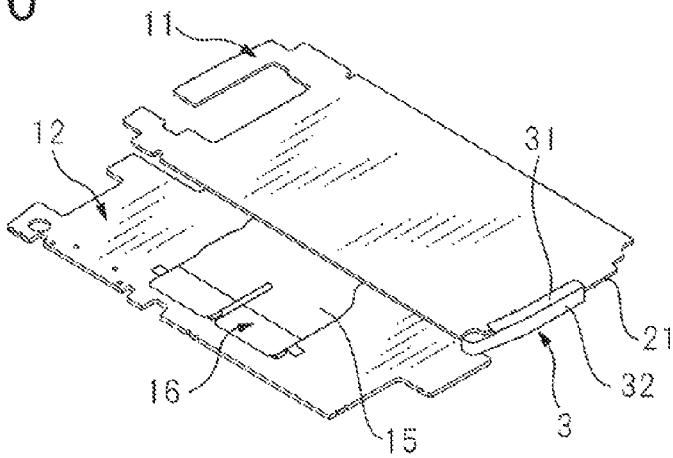
FIG. 20 is a perspective view which illustrates the state where the antenna which is illustrated in FIG. 17 to FIG. 19 is attached to the first circuit board which is illustrated in FIG. 5.
Figure 21:
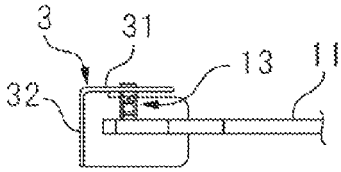
FIG. 21 is a partial cross-sectional view which illustrates a state where an antenna of the first embodiment of the present application is attached instead of the antenna which is illustrated in FIG. 7.
Figure 22:
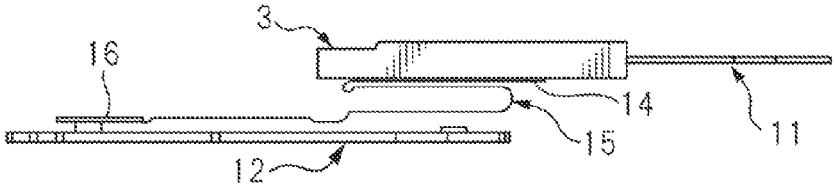
FIG. 22 is a partial cross-sectional view which illustrates a state where an antenna of the first embodiment of the present application is attached instead of the antenna which is illustrated in FIG. 8.
Figure 23:
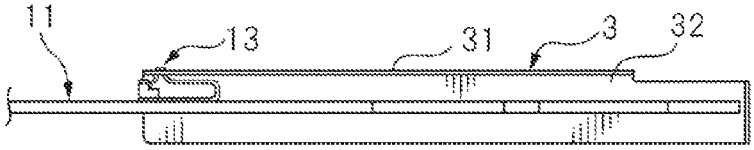
FIG. 23 is a partial cross-sectional view which illustrates a state where an antenna of the first embodiment of the present application is attached instead of the antenna which is illustrated in FIG. 6.

FIG. 20 is a perspective view which illustrates the state where the antenna 3 which is illustrated in FIG. 17 to FIG. 19 is attached to the end 21 of the first circuit board 11. This corresponds to the configuration which is illustrated in FIG. 5. FIG. 21 is a partial cross-sectional view which illustrates the state where the antenna 3 of the first embodiment of the present application is attached instead of the antenna 3 which is illustrated in FIG. 7. Further, FIG. 22 is a partial cross-sectional view which illustrates the state where the antenna 3 of the first embodiment of the present application is attached instead of the antenna 3 which is illustrated in FIG. 8. Furthermore, FIG. 23 is a partial cross-sectional view which illustrates the state where the antenna 3 of the first embodiment of the present application is attached instead of the antenna 3 which is illustrated in FIG. 6.

Figure 24:
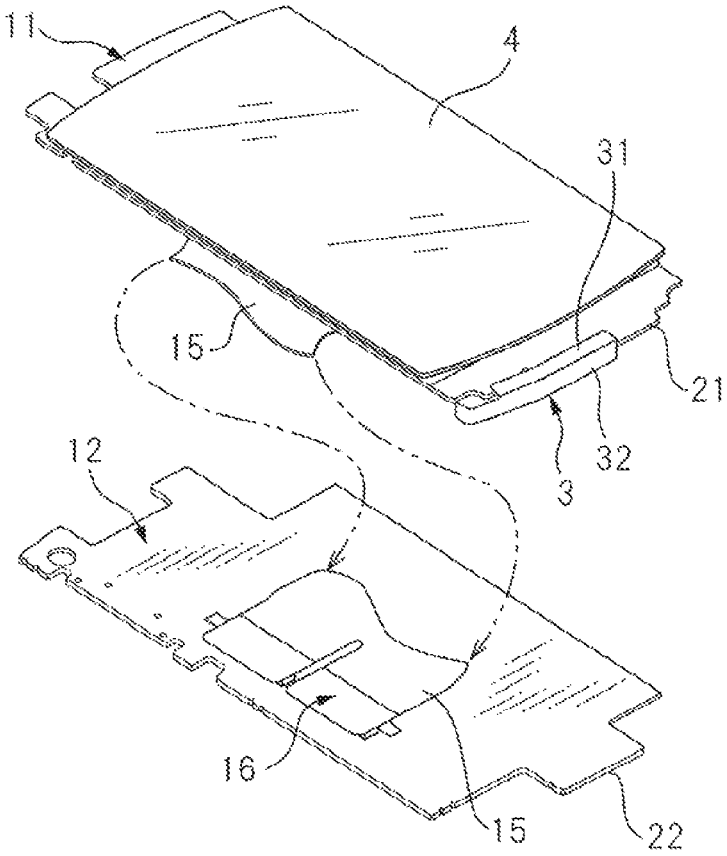
FIG. 24 is a perspective view which illustrates a state where a display is attached to a first circuit board which is illustrated in FIG. 20.

Further, FIG. 24 is a perspective view which illustrates the second circuit board 12 as a whole when cutting the flexible cable 15 which connects the first circuit board 11 and second circuit board 12 which are illustrated in FIG. 20 and which illustrates the state when attaching a display 4 to the first circuit board 11.

Figure 25:
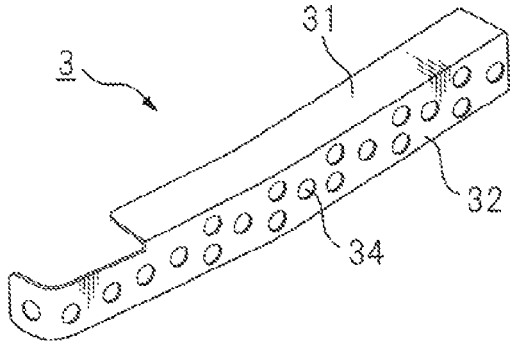
FIG. 25 is a perspective view of a modified embodiment of an antenna of the first embodiment of the present application.
Figure 26:
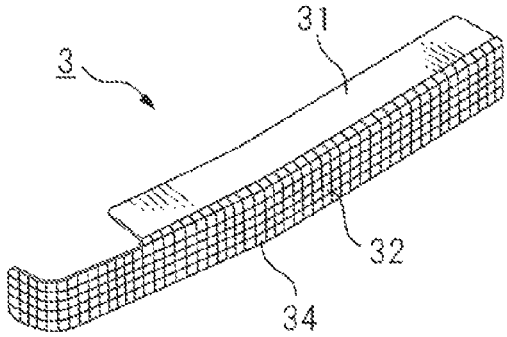
FIG. 26 is a perspective view of a modified embodiment of an antenna of the first embodiment of the present application.
Figure 27:
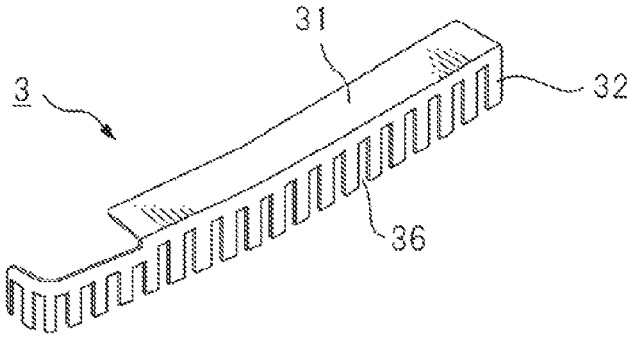
FIG. 27 is a perspective view of a modified embodiment of an antenna of the first embodiment of the present application.

FIG. 25 to FIG. 27 are perspective views which illustrate the structures of antennas of modified embodiments of the antenna 3 of the first embodiment of the present application which is illustrated in FIG. 17 to FIG. 19. At the antenna 3 which is illustrated in FIG. 25, the second antenna part 31 is provided with a plurality of small through holes 34. At the antenna 3 which is illustrated in FIG. 26, the second antenna part 31 is formed by mesh wire 35. Furthermore, at the antenna 3 which is illustrated in FIG. 27, the second antenna part 32 is formed with a plurality of slits 36 and the second antenna board 31 is formed in a comb shape. These modified embodiments are for reducing the weight of the antenna 3.

Figure 28:
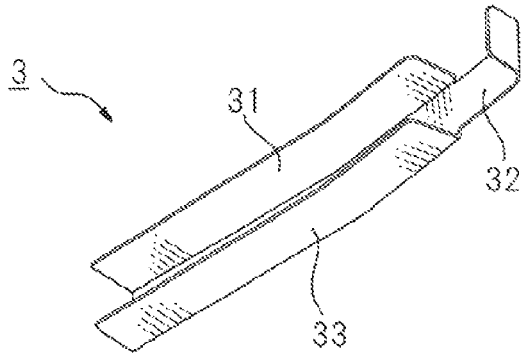
FIG. 28 is a perspective view which views the specific shape of the antenna of the second embodiment of the present application from the same direction as the direction of the antenna of the first embodiment which is illustrated in FIG. 19.
Figure 29:
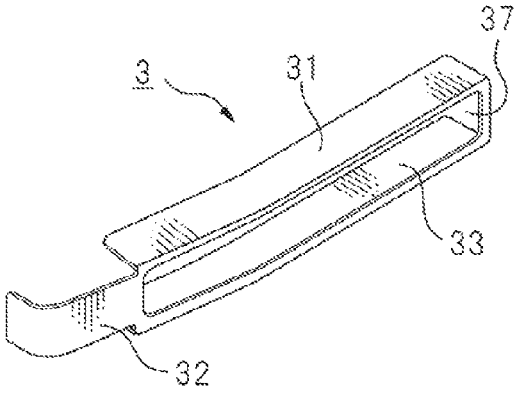
FIG. 29 is a perspective view which views the shape of an antenna of a modification of the second embodiment of the present application from the same direction as the direction of the antenna of the first embodiment which is illustrated in FIG. 17.

FIG. 28 is a perspective view which illustrates the specific shape of the antenna 3 of the second embodiment of the present application. This figure illustrates the specific shape of the antenna 3 of the second embodiment as viewed from the same direction as the direction of the antenna 3 of the first embodiment which is illustrated in FIG. 19. Further, FIG. 29 is a perspective view which illustrates one example of a modification of the antenna 3 of the second embodiment of the present application and is a view from the same direction as the antenna 3 of the first embodiment which is illustrated in FIG. 17. In this modification, the second antenna part 32 is provided with a large through hole 37 so as to reduce the weight of the antenna 3.

Figure 30:
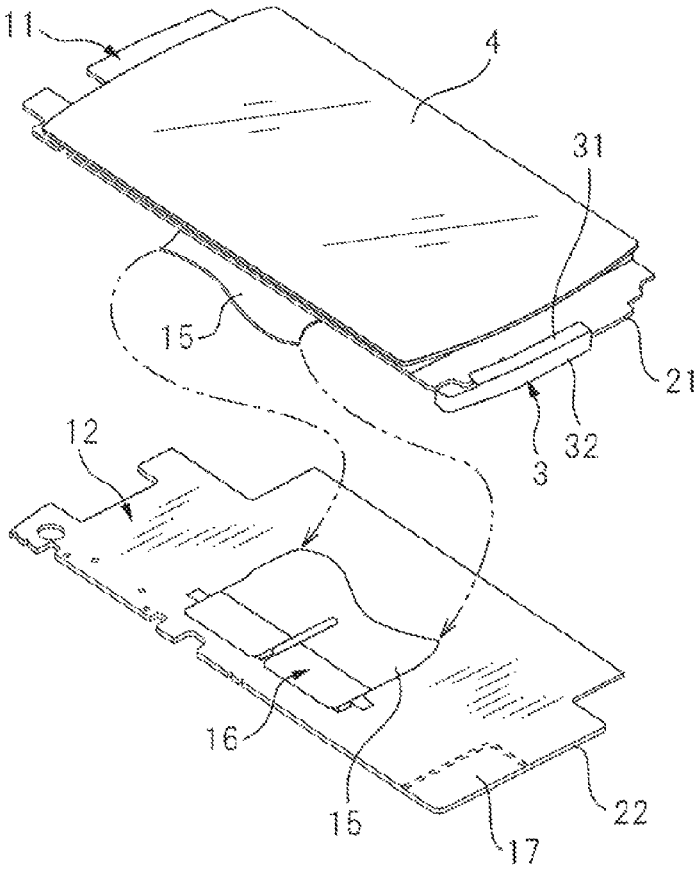
FIG. 30 is a perspective view which illustrates a configuration where the second circuit board which is illustrated in FIG. 24 is replaced with the second circuit board of the third embodiment of the present application.

FIG. 30 is a perspective view which illustrates a configuration where the second circuit board 12 which is illustrated in FIG. 24 is replaced by the second circuit board 12 of the third embodiment of the present application. In the third embodiment, the end 22 of the second circuit board 12 at the antenna 3 side is extended whereby a board extension part 17 is formed. The board extension part 17 is positioned right under the antenna 3 which is connected to the first circuit board 11 when the first circuit board 11 is superposed over the second circuit board 12.

Figure 31:
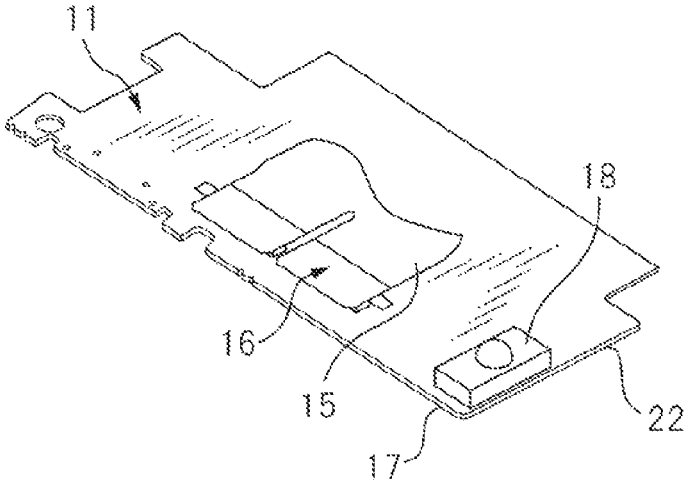
FIG. 31 is a perspective view which illustrates the configuration of a second circuit board of a fourth embodiment of the present application.

FIG. 31 is a perspective view which illustrates the specific configuration of the second circuit board 12 of the fourth embodiment of the present application. In the fourth embodiment, at the end 22 of the second circuit board 12 at the antenna 3 side, a part 18 which includes a conductor, for example, a track ball 18, is attached. The track ball 18 may be directly attached to the second circuit board 12, but it is also possible to provide a board extension part 17 similar to the third embodiment and attach the ball to the board extension part 17. The part 18 which includes a conductor is positioned right under the antenna 3 which is connected to the first circuit board 11 when the first circuit board 11 is superposed over the second circuit board 12.

Figure 32:
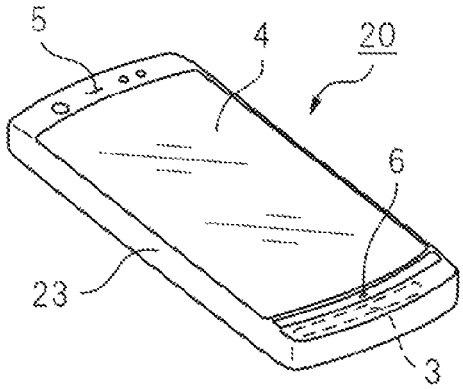
FIG. 32 is a perspective view of a straight-type mobile phone of one example of a mobile communication device of the second embodiment according to the present application in which the first circuit board and the second circuit board are set in a single housing.
Figure 33:
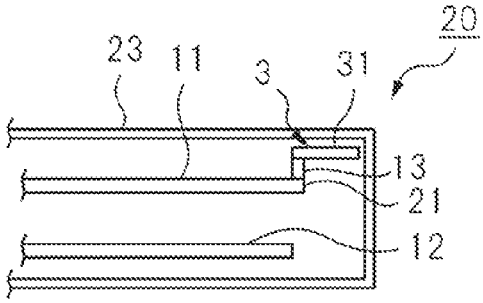
FIG. 33 is a partial cross-sectional view which illustrates a conventional antenna structure in a mobile communication device of a second aspect according to the present application.

FIG. 32 is a perspective view which illustrates a mobile communication device 20 of the second aspect according to the present application in which the first circuit board and the second circuit board are arranged in a single housing. The mobile communication device 20 of the second aspect is, for example, a straight-type mobile phone 20. FIG. 33 is a partial cross-sectional view which illustrates a conventional antenna structure in the straight-type mobile phone 20. At the inside of a one-piece housing 23 of the conventional straight-type mobile phone 20, a first circuit board 11 and a second circuit board 12 are provided in parallel. A thin strip antenna 3 which is provided with only the first antenna part 31 is connected to the end 21 of the first circuit board 11 by the connection terminal 13.

In the present application, in the straight-type mobile phone 20 of the second aspect as well, the current EC which flows to the first circuit board 11 is dispersed and the dispersed current ec is made to flow to the second circuit board 12. FIG. 34 to FIG. 37 are partial cross-sectional views which illustrate basic first to fourth embodiments of the present application in the second aspect. Here, illustration of the current EC which flows through the first circuit board 11 and the current ec which flows through the second circuit board 12 in the first to fourth embodiments of the second aspect is omitted. Further, illustration of the fifth to eight embodiments of combinations of the first to fourth embodiments such as illustrated from FIG. 13 to FIG. 16 in the second aspect will also be omitted.

Figure 34:
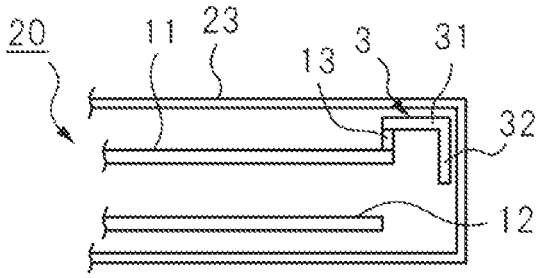
FIG. 34 is a partial cross-sectional view of a mobile communication device of the second aspect of the present application to which an antenna in the first embodiment of the mobile communication device of the present application which is illustrated in FIG. 9 is attached.

FIG. 34 is a partial cross-sectional view which illustrates the shape of the antenna 3 in a first embodiment of the straight-type mobile phone 20 of the present application. In the first embodiment, the antenna 3 which is connected through the connection terminal 13 to the first circuit board 11 which is housed in the housing 23 includes the first antenna part 31 and the second antenna part 32. The first antenna part 31 is provided laid along the end 21 of the first circuit board 11 in a direction parallel to the first circuit board 11, while the second antenna part 32 is provided extending from the end of the first antenna part 32 and bent to the second circuit board 12 side. The current which flows to the first circuit board 11 flows dispersed to the second circuit board 12 due to this second antenna part 32.

Figure 35:
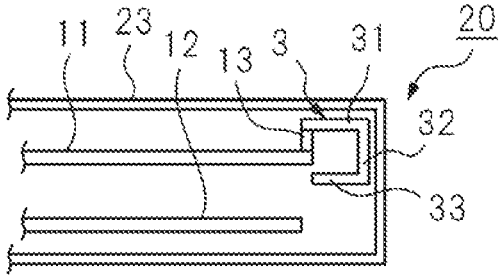
FIG. 35 is a partial cross-sectional view of a mobile communication device of the second aspect of the present application to which an antenna in the second embodiment of the mobile communication device of the present application which is illustrated in FIG. 10 is attached.

FIG. 35 is a partial cross-sectional view which illustrates the shape of the antenna 3 in a second embodiment of the straight-type mobile phone 20 of the present application. In the second embodiment, the antenna 3 which is connected through the connection terminal 13 to the first circuit board 11 which is housed in the housing 23 includes the first antenna part 31, second antenna part 32, and third antenna part 33. The first antenna part 31 is provided laid along the end 21 of the first circuit board 11 in a direction parallel to the first circuit board 11, while the second antenna part 32 is provided extending from the end of the first antenna part 32 and bent to the second circuit board 12 side. Furthermore, the third antenna part 33 is provided extending from the end of the second antenna part 32 and bent at this extension part in a direction parallel to the second circuit board 12. The current which flows to the first circuit board 11 flows dispersed to the second circuit board 12 due to this second antenna part 32 and third antenna part 33.

Figure 36:
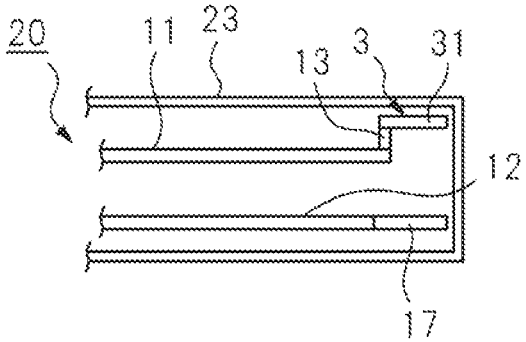
FIG. 36 is a partial cross-sectional view of a mobile communication device of the second aspect of the present application to which an antenna in the third embodiment of the mobile communication device of the present application which is illustrated in FIG. 11 is attached.

FIG. 36 is a partial cross-sectional view which illustrates the shape of the second circuit board 12 in a third embodiment of the lateral slide-type mobile phone 10 of the present application. In the third embodiment, the antenna 3 which is connected through the connection terminal 13 to the first circuit board 11 which is housed in the housing 23 includes only the first antenna part 31. On the other hand, the end 22 of the second circuit board 12 is extended by the board extension part 17 to a position right under the antenna 3. The current which flows through the first circuit board 11 flows dispersed to the second circuit board 12 due to this board extension part 17.

Figure 37:
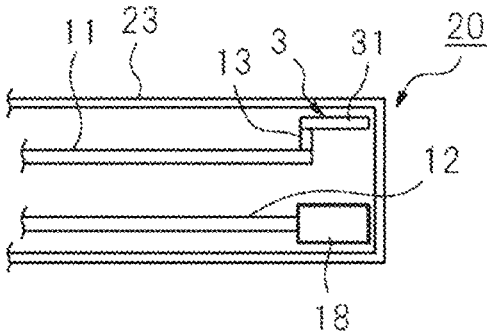
FIG. 37 is a partial cross-sectional view of a mobile communication device of the second aspect of the present application to which an antenna in the fourth embodiment of the mobile communication device of the present application which is illustrated in FIG. 12 is attached.

FIG. 37 is a partial cross-sectional view which illustrates the shape of the second circuit board 12 in a fourth embodiment of the straight type mobile phone 20 of the present application. In the fourth embodiment, the antenna 3 which is connected through the connection terminal 13 to the first circuit board 11 which is housed in the housing 23 includes only the first antenna part 31. On the other hand, at the end 22 of the second circuit board 12, a part 18 which includes a conductor is attached so as to be positioned right under the antenna 3. The part 18 which includes a conductor may also be attached to the second circuit board 12 without extending from the end 22 of the second circuit board 12. Further, the end 22 of the second circuit board 12 may also be extended and that extension part attached to. The current which flows to the first circuit board 11 flows dispersed to the second circuit board 12 due to the part 18 including this conductor.

In the mobile communication device of the first aspect and second aspect configured in the above way, if configuring the antenna like in the first embodiment, the amount of the effect received from the user body at the time of use of the mobile communication device becomes 20% or so smaller. Further, if configuring the antenna like in the second embodiment, the amount of the effect received from the user body at the time of use of the mobile communication device becomes 40% or so smaller. As a result, the gain of the antenna is improved 12.5% or so in the first embodiment and is improved 16.7% or so in the second embodiment.

Note that, as illustrated in the first and second embodiments of the present application, it may also be considered not to bend the end of the antenna 3 to the second circuit board side, but to increase the thickness of the antenna 3 itself and electromagnetically couple this to the second circuit board, but the antenna characteristics would end up deteriorating, so this is low in practicality.

According to the present application, it becomes possible to improve the antenna performance in a mobile communication device where an antenna is mounted inside the housing at the side close to the user body at the time of use.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A mobile communication device comprising:

a first circuit board;

a second circuit board which faces the first circuit board; and an antenna which is connected to the first circuit board, said antenna further comprising:

a first antenna part which is laid in a direction parallel to the first circuit board; and a second antenna part which is laid in direction bent to a second circuit board side at the end of the first antenna part at a side far from the first circuit board, wherein an end part of said second circuit board is provided with a board extension part which is extended up to a position right under said antenna.

2. The mobile communication device as claimed in claim 1, wherein said second antenna part is provided with, at its end, a third antenna part which is extended in a direction parallel to said second circuit board.

3. The mobile communication device as claimed in claim 2, wherein an end part of said second circuit board is provided with a board extension part which is extended up to a position right under said antenna.

4. The mobile communication device as claimed in claim 2, wherein said second circuit board is provided with a part including a conductor right under said antenna.

5. The mobile communication device as claimed in claim 1, wherein said second circuit board is provided with a part including a conductor right under said antenna.

6. The mobile communication device as claimed in claim 1, wherein said second antenna part is provided with a plurality of holes.

7. The mobile communication device as claimed in claim 1, wherein said second antenna part is a mesh structure.

8. The mobile communication device as claimed in claim 1, wherein said second antenna part is provided with a plurality of slits from its end side.

9. The mobile communication device as claimed in claim 1, wherein said second antenna part includes a member separate from said first antenna part and is joined to the first antenna part.

10. The mobile communication device as claimed in claim 1, wherein said second antenna part and said third antenna part are comprised of members separate from said first antenna part, said second antenna part is joined to said first antenna part, and said third antenna part is joined to said second antenna part.

11. The mobile communication device as claimed in claim 1, wherein said mobile communication device is a slide type communication device with an upper housing which slides with respect to a lower housing, said first circuit board is housed in said upper housing, and said second circuit board is housed in said lower housing.

12. The mobile communication device as claimed in claim 11, wherein said second antenna part is provided with, at its end, a third antenna part which is extended in a direction parallel to said second circuit board.

13. The mobile communication device as claimed in claim 1, wherein said mobile communication device is a straight type communication device provided with a one-piece housing, and said first circuit board and said second circuit board are housed in said one-piece housing.

14. The mobile communication device as claimed in claim 13, wherein said second antenna part is provided with, at its end, a third antenna part which is extended in a direction parallel to said second circuit board.

15. A mobile communication device comprising:

a first circuit board;

a second circuit board which faces the first circuit board; and an antenna which is connected to the first circuit board, said antenna further comprising:

a first antenna part which is laid in a direction parallel to the first circuit board; and a board extension part which includes an end of the second circuit board extended to a position right under the first antenna part.

16. A mobile communication device comprising:

a first circuit board;

a second circuit board which faces the first circuit board; and an antenna which is connected to the first circuit board, said antenna further comprising:

a first antenna part which is laid in a direction parallel to the first circuit board; and a part which includes a conductor which is attached to an end of the second circuit board and which is positioned right under the first antenna part.

17. The mobile communication device as claimed in claim 16, wherein said part including a conductor is attached to an end part of said second circuit board without extending said second circuit board.

18. The mobile communication device as claimed in claim 16, wherein an end part of said second circuit board is extended in the direction of said first antenna part and wherein said part including a conductor is attached to the extension part of said second circuit board.

19. The mobile communication device as claimed in claim 18, wherein said part including a conductor is a track ball.

* * * * *